United States Patent [19]

Fitzgerald et al.

[11] Patent Number: 4,767,095

[45] Date of Patent: Aug. 30, 1988

[54] CONCRETE COLUMN FORM

[76] Inventors: John M. Fitzgerald, 321 Signe Ct., Lake Bluff, Ill. 60044; Gary L. Workman, 443 N. Joyce, Lombard, Ill. 60148

[21] Appl. No.: 110,224

[22] Filed: Oct. 19, 1987

Related U.S. Application Data

[63] Continuation-in-part of Ser. No. 867,947, May 29, 1986, abandoned.

[30] Foreign Application Priority Data

Dec. 23, 1986 [CA] Canada ..... 526198

[51] Int. Cl.[4] ..... E04G 13/02

[52] U.S. Cl. ..... 249/48; 249/51; 249/61; 249/112; 249/134

[58] Field of Search ..... 249/17, 48, 51, 61, 249/112, 114 R, 134, 143, 173, DIG. 2, DIG. 4; 264/230, DIG. 71; 229/93, 3.1, 3.5 R; 138/137, 140, 143, 177, 178, DIG. 5, 144

[56] References Cited

U.S. PATENT DOCUMENTS

| | | | |
|---|---|---|---|
| 2,873,503 | 2/1959 | Davis | 249/48 |
| 2,991,533 | 7/1961 | Reid et al. | 249/48 |
| 3,301,926 | 1/1967 | Reiland | 249/48 |
| 3,350,049 | 10/1967 | Reiland | 249/48 |
| 3,751,196 | 8/1973 | Cannon et al. | 249/48 |
| 3,959,052 | 5/1976 | Stanek | 264/DIG. 71 |
| 4,001,065 | 1/1977 | Penneck et al. | 264/DIG. 71 |
| 4,595,168 | 6/1986 | Goodwin | 249/51 |

*Primary Examiner*—Jay H. Woo
*Assistant Examiner*—James C. Housel
*Attorney, Agent, or Firm*—Wood, Dalton, Phillips, Mason & Rowe

[57] ABSTRACT

A lightweight, concrete form having an inner elongate cylindrical member with an internal opening having a cross section to provide the desired shape for a concrete column and a layer of thin stretch film stretched about the inner member to place the inner member in compression and with the ends of the film overlapped for self-adherence.

10 Claims, 1 Drawing Sheet

FIG. 1
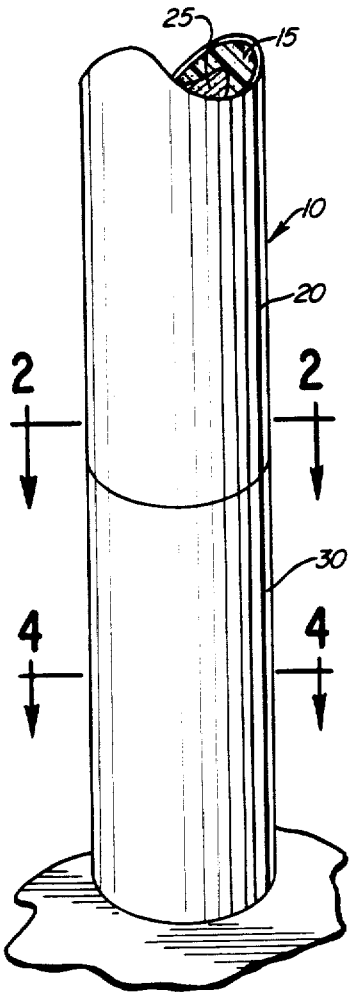
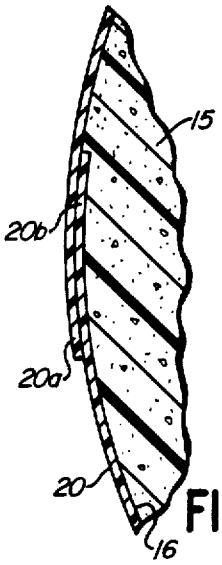
FIG. 3
FIG. 2
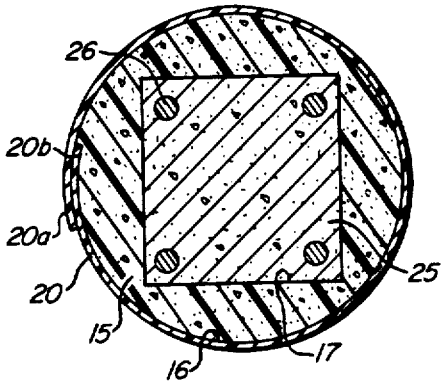
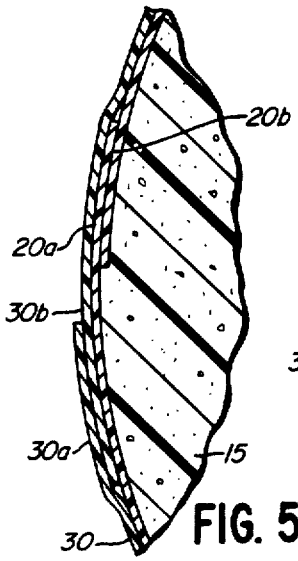
FIG. 5
FIG. 4
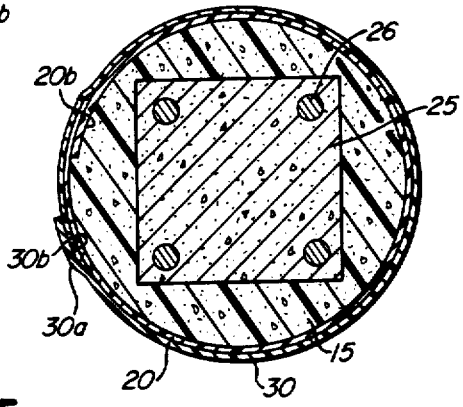
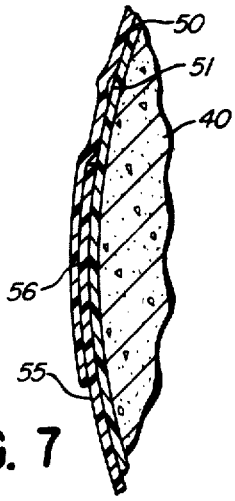
FIG. 7
FIG. 6
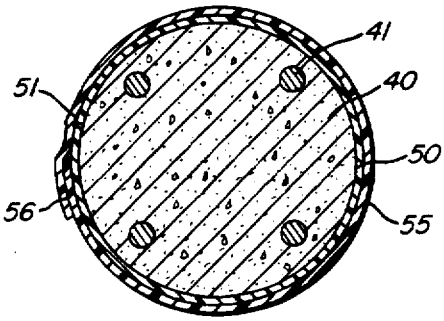

CONCRETE COLUMN FORM

RELATED APPLICATION

This application is a continuation-in-part of Ser. No. 867,947, filed May 29, 1986 now abandoned.

TECHNICAL FIELD

This invention pertains to a lightweight, single-use concrete form for molding a concrete column. The concrete form can be constructed to form either a round or square column or other polygonally-shaped column. The concrete form has an inner elongate cylindrical member having an internal opening of the desired cross-sectional shape for the concrete column and an external wrap of a layer of tensioned plastic stretch film which is resiliently stretched in application to place the inner cylindrical member in compression. The methods embodied in manufacture of the concrete form include the forming of the inner elongate cylindrical member and then stretching a layer of stretch film around the inner elongate cylindrical member with the film ends overlapped for self-adherence.

BACKGROUND ART

A well known concrete form for molding a round concrete column has a shell made up of several wound layers of paper material which are bonded together. In forming columns of a shape other than round, such as a square column, it is conventional to assemble forms, such as wooden or steel forms, on the construction site.

Included in the patent art are U.S. Pat. Nos. 2,873,503, 2,991,533, 3,301,926, and 3,350,049, which disclose prefabricated concrete forms for molding a noncircular concrete column. These patents do not show a concrete form having an inner elongate cylindrical member with an integral opening of the desired cross section for the concrete column and a cylindrical exterior which is enclosed in a layer of plastic stretch film stretched in situ to place the inner member in compression to provide adequate strength to resist the outward pressure of the poured concrete.

DISCLOSURE OF THE INVENTION

A primary feature of the invention is to provide a lightweight, single-use concrete form for molding a concrete column having an elongate inner cylindrical member with an internal opening of the shape desired for the concrete column and an outer wrap defined by a layer of stretch film resiliently stretched in application onto the cylindrical member to place the inner member in compression to withstand the pressure exerted by the poured concrete.

Additional features of the invention reside in the construction of the concrete form set forth in the preceding paragraph wherein the stretch film has the ends thereof overlapped to provide for self-adherence of the film and the inner member can be constructed of a plastic material, such as polyurethane or polyethylene foam, which is either initially molded or fabricated to the desired circular outer periphery and to have an internal opening of the desired cross-sectional shape for the column. The improved concrete form can also be constructed of a sheet of plastic shaped into a cylinder and similarly surrounded by a layer of resiliently stretched film which exerts the necessary compression to strengthen the plastic sheet. An example of a plastic for the sheet is a high impact polystyrene.

An object of the invention is to provide a single-use concrete form for molding a concrete column, comprising, in combination, an inner elongate cylindrical member having, in cross section, a circular outer periphery and an internal opening to receive the poured concrete and which has the desired shape for the cross section of the concrete column, and a layer of resiliently stretched plastic stretch film wrapped about the inner elongate cylindrical member to place and maintain the latter member in compression.

Still another object of the invention is to provide a concrete form for a poured concrete column comprising, in combination, a lightweight inner member having a circular outer periphery and an internal hollow shape to receive poured concrete and form the desired column cross section, and a layer of resiliently stretched platic film wound about the inner member with the ends overlapped for self-adherence and wound onto the inner member under sufficient tension to provide in the range of 75% to 150% stretch and place said inner member in compression sufficient to withstand the force exerted by poured concrete.

BRIEF DESCRIPTION OF THE DRAWINGS

FIG. 1 is a perspective fragmentary elevational view of the concrete form with concrete therein;

FIG. 2 is a transverse sectional view, taken generally along the line 2—2 and on an enlarged scale and with the outer wrap enlarged for clarity;

FIG. 3 is a fragmentary view of the structure shown at the left in FIG. 2, again with the outer wrap enlarged for clarity;

FIG. 4 is a transverse sectional view, taken generally along the line 4—4 in FIG. 1 and on an enlarged scale and with the outer wrap further enlarged for clarity;

FIG. 5 is an enlarged view of a part of FIG. 4 at the left thereof, illustrating the detail of the structure and with the outer wrap further enlarged for clarity;

FIG. 6 is a view, similar to FIG. 2, of a second embodiment of the concrete form; and FIG. 7 is an enlarged view of the left-hand portion of FIG. 6 and with the outer wrap enlarged for clarity.

BEST MODES FOR CARRYING OUT THE INVENTION

The concrete form is shown in place in FIG. 1 and is indicated generally at 10. The structure of the form is shown more particularly in FIGS. 2–5. The form has an inner, elongate cylindrical member 15 formed of a lightweight plastic material, for example, a polyurethane or a polyethylene foam having a circular outer periphery 16 and an internal opening 17 which is of a cross-sectional shape to provide the desired cross-sectional shape for the concrete column. The plastic material has sufficient strength in compression to resist crushing as a result of pressure exerted by concrete poured into the form, but does not have sufficient strength to prevent bursting as a result of forces generated by the poured concrete.

The inner elongate cylindrical member 15 can either be molded to the cross-sectional shape shown in FIG. 2 or fabricated from a block of plastic material, such as foam, to the desired internal and external configurations.

The inner member 15 is placed in compression to prevent bursting by a layer of plastic stretch film 20 which is stretched as it is wrapped circumferentially in a single layer about the inner member under substantial circumferential tension and with adjacent ends 20a and 20b of the film overlapped for self-adherence which is characteristic of the film.

Stretching of the plastic stretch film as it is wrapped about the inner member imparts added strength to the film and the film has resiliency in that it wants to return to its original dimensions which results in substantial compressive force on the inner member.

The compression forces on the inner member result from the tensioned wrapping of the plastic shrink film onto the inner member and also from the resilient stretch of the film as it is applied. The stretched film, in attempting to return to its non-stretched state, increases the compressive force beyond that achieved by merely tension winding.

In using the plastic stretch film, the inner member 15 is placed on a mandrel of a stretch wrapping machine, such as a Lan-wrapper machine of Lantech Corporation, and the machine is operated to place a single layer of the film about the inner member and with an adequate overlap of the ends to provide the self-adherence. Examples of usable stretch films are either a coextruded linear low-density polyethylene film or a film made from a blend of ethyl vinyl acetate and linear low-density polyethylene. The film can have a thickness in the range of 60–1.60 mils. A commercially available material is MOBILRAP film, marketed by Mobil Chemical. Other plastic stretch films are also commercially available.

The stretch film can be wrapped about the inner member with a tension which produces 250% stretch. A stretch in the range of 75% to 150% has been found to adequately increase the strength of the film and impart resilient compression on the inner member to make a satisfactory product.

The stretch film is thin and lightweight to enable easy handling of the concrete form in use and has adequate tensile strength to place the inner member in compression to resist the pressure exerted by concrete poured into the concrete form. In stretching the film onto the inner member, the film is resiliently stretched which contributes to resisting the forces created by concrete poured into the form. The film maintains the support while the concrete sets.

The concrete column is seen in FIGS. 1 and 2 wherein the concrete 25 forms a square column, as defined by a square shape of the internal opening 17 in the inner member 15 and has reinforcing bars 26 extending lengthwise thereof and imbedded in the concrete.

A single layer of the stretched film 20 is normally adequate for a concrete form for pouring a column of normal height. If an unusually tall or large diameter column is to be poured, the concrete form can be constructed with multi-layers of stretched film. This structure for the lower portion of a tall column is shown in FIGS. 4 and 5 wherein a second layer 30 of film is stretched about the previously-described layer 20. The layer 30 has overlapped ends 30a and 30b for self-adherence of this outer layer.

The cross-sectional shape of the column is shown as being square, although it will be obvious that the column can be round or of some polygonal shape other than square, with a suitable shaping of the internal opening of the inner member 15. The thickness of the layers 20 and 30 is greatly exaggerated in the drawings for clarity. It will be evident from the dimensions given for the thickness of the film of the layers that the actual thickness thereof is almost imperceptible when considering a concrete form of a size to form the column.

The concrete form is extremely light and easy to handle, since it has an inner member of lightweight plastic material, such as foam, which, in one embodiment, could have a weight of approximately 2 pounds per cubic foot and the thin stretch film which places the foam in compression has very little weight.

After the concrete has set, a vertical cut may be made along the length of the concrete form for easy separation thereof for removal from the concrete column.

Another embodiment of the invention is shown in FIGS. 6 and 7 wherein the concrete form is constructed of components shaped for pouring a round column.

In this embodiment, a round concrete column has concrete 40 with reinforcing rods 41. The concrete form has an inner elongate cylindrical member 50 formed from a sheet of plastic material which is bonded along adjacent edges at a butt joint 51. A layer 55 of stretch film surrounds the inner member 50, with the ends of the film overlapped, as shown at 56, and is stretched as described in connection with the film layer 20 in the embodiment of FIG. 2. The butt seal 51 between adjacent edges of the sheet 50 is only for the purpose of resisting compression exerted as the film layer 55 is stretched about the inner member 50. An example of a suitable member for forming the inner elongate cylindrical member 50 is a one-inch thick, high impact polystyrene sheet material. It is within the scope of the invention to use other materials and thicknesses for the inner member and to shape the interior of the interior member to form columns other than round.

It is characteristic of polyurethane foam to have a skin which will result in a satisfactory surface for the concrete column. In order to achieve a smooth column surface when using polystyrene foam, a liner (not shown) can be inserted within the internal opening of the inner elongate cylindrical member 15 and this can also be removed after the concrete has set.

The method of making a lightweight, single-use concrete form is believed evident from the foregoing description. The first step is the forming of an inner elongate cylindrical member with an internal opening of a desired cross-sectional shape for the cross-sectional shape of a concrete column to be formed, followed by stretching of a sheet of plastic stretch film about the inner elongate cylindrical member to place the inner member in compression, with overlapping of the ends of the film to achieve self-adherence of the film without any sealing thereof being required.

We claim:

1. A single-use concrete form for molding a concrete column, comprising, in combination, an inner elongate cylindrical member having, in cross section, a circular outer periphery and an internal opening to receive the poured concrete and which has a desired shape for the cross section of the concrete column, and a layer of thin plastic stretch film resiliently stretched at least about 75% of the film's initial length about the inner elongate cylindrical member to place the latter member in compression.

2. A concrete form as defined in claim 1 wherein said thin plastic stretch film has ends overlapped for self-adherence.

3. A concrete form as defined in claim 1 wherein said inner member is formed of plastic foam.

4. A concrete form as defined in claim 3 wherein said plastic foam is a polyurethane.

5. A concrete form as defined in claim 3 wherein said plastic foam is a polystyrene.

6. A concrete form as defined in claim 1 wherein said inner member is formed of a sheet of plastic material.

7. A concrete form as defined in claim 6 wherein said plastic material is high impact polystyrene.

8. A concrete form as defined in claim 1 wherein the form has upper and lower ends, the lower end thereof has a second layer of thin plastic stretch film stretched onto said first-mentioned layer of thin plastic stretch film for increased strength.

9. A lightweight concrete form comprising, in combination, an inner tubular member of sheet plastic material, and an outer wrap of a layer of thin plastic stretch film resiliently stretched at least about 75% of the film's initial length around the inner tubular member to place said inner tubular member in compression.

10. A single-use concrete form for molding a concrete column, comprising, in combination, an inner elongate cylindrical member having, in cross section, a circular outer periphery and an internal opening to receive poured concrete and which has a desired shape for the cross section of the concrete column, and a layer of thin tensioned plastic stretch film wrapped circumferentially about the inner elongate cylindrical member under substantial circumferential tension to be substantially resiliently stretched at least about 75% of the film's initial length and place said cylindrical member in compression, said film comprising a film having an increased strength as a result of being stretched sufficient to prevent bursting of the cylindrical member by the expansion forces directed thereagainst by the poured concrete and to provide maintained support of the concrete as it sets.

* * * * *